US005472338A

United States Patent [19]

Ansquer

[11] Patent Number: 5,472,338

[45] Date of Patent: Dec. 5, 1995

[54] CIGARETTE LIGHTER SAFETY WITH THUMB LOCKING MECHANISM

[76] Inventor: Henri Ansquer, 8A Impasse de la Minoterie, Quimper, France

[21] Appl. No.: 218,506

[22] Filed: Mar. 25, 1994

[30] Foreign Application Priority Data

May 28, 1993 [FR] France ..... 93 06409

[51] Int. Cl.[6] ..... F23D 11/36

[52] U.S. Cl. ..... 431/153; 431/277; 222/153.14

[58] Field of Search ..... 431/153, 255, 431/277

[56] References Cited

U.S. PATENT DOCUMENTS

| | | |
|---|---|---|
| 1,895,032 | 1/1933 | Fisher . |
| 2,520,328 | 8/1950 | Nissen . |
| 2,727,376 | 12/1955 | Felt . |
| 3,169,672 | 2/1965 | Soffer et al. . |
| 3,859,035 | 1/1975 | Schlamp . |
| 3,924,782 | 12/1975 | Starrett . |
| 3,938,943 | 2/1976 | Malamoud . |
| 3,961,876 | 6/1976 | Chernock . |
| 4,024,988 | 5/1977 | Starrett . |
| 4,028,043 | 6/1977 | Neyret . |
| 4,049,370 | 9/1977 | Neyret . |
| 4,157,891 | 6/1979 | Moriya . |
| 4,243,377 | 1/1981 | Schmid . |
| 4,295,819 | 10/1981 | Sugiyama . |
| 4,332,549 | 6/1982 | Fuller . |
| 4,403,945 | 9/1983 | Letgib . |
| 4,432,542 | 2/1984 | Poynter . |
| 4,471,404 | 1/1985 | Nitta . |
| 4,496,309 | 5/1985 | Schachter . |
| 4,516,933 | 12/1985 | Buzzi . |
| 4,560,345 | 2/1986 | Schachter . |
| 4,569,654 | 6/1986 | Borghesi . |
| 4,595,352 | 1/1988 | Endelson . |
| 4,717,335 | 7/1988 | Loveless . |

FOREIGN PATENT DOCUMENTS

| | | |
|---|---|---|
| 1145658 | 5/1983 | Canada . |
| 285748 | 10/1988 | European Pat. Off. . |
| 296281 | 12/1988 | European Pat. Off. . |
| 312627 | 4/1989 | European Pat. Off. . |
| 89308631 | 8/1989 | European Pat. Off. . |
| 2220047 | 9/1974 | France . |
| 2280029 | 2/1976 | France . |
| 2465161 | 3/1981 | France . |
| 2568838 | 5/1981 | France . |
| 2633702 | 7/1988 | France . |
| 3040596 | 5/1981 | Germany . |
| 8802582 | 4/1988 | Germany . |
| 52-117197 | 9/1977 | Japan . |
| 56-85638 | 7/1981 | Japan . |
| 56-32749 | 8/1987 | Japan . |
| 636943 | 6/1983 | Switzerland . |
| 2062200 | 5/1981 | United Kingdom . |
| 2072820 | 7/1981 | United Kingdom . |
| 8100752 | 3/1981 | WIPO . |

OTHER PUBLICATIONS

Certificate of Accuracy for German Patent No. 8,802,582.

Certificate of Accuracy of French Patent Publication No. 2,220,047.

Certificate of Accuracy for French Patent Publication No. 2,280,029.

Certificate of Accuracy for French Patent Publication No. 2,465,161.

Certificate of Accuracy for WIPO Patent Publication No. 8,100,752.

*Primary Examiner*—Carl D. Price

*Attorney, Agent, or Firm*—Morgan & Finnegan

[57] ABSTRACT

A safety lighter having a body, a value for releasing gas, an ignitor, and a locking mechanism. According to the invention, a resilient "U"-shaped spring is closed at its upper portion by an arm carrying retractable stops, the stops preventing, in the locked position, the descent of the thumbpiece and therefore the igniting of the cigarette lighter. The safety device of the present invention allows an increase in safety, particularly where children are concerned.

(List continued on next page.)

10 Claims, 2 Drawing Sheets

U.S. PATENT DOCUMENTS 4,758,152 9/1988 Kordecki .
4,773,849 11/1988 Schacter .
4,784,601 11/1988 Nitta .
4,784,602 11/1988 Nitta .
4,786,248 11/1989 Nitta .
4,799,877 1/1989 Bisbee .
4,822,276 4/1989 Bisbee .
4,830,603 5/1989 Cirami .
4,832,596 5/1989 Morris, Sr. .
4,850,854 7/1989 Buck .
4,859,172 8/1989 Nitta .
4,869,662 9/1989 LeCourt et al. .
4,869,663 9/1989 Fremund .
4,878,836 11/1989 Nitta .
4,884,965 12/1989 Nitta .
4,889,482 12/1989 Schachter .
4,904,180 2/1990 Nitta .
4,921,420 5/1990 Johnson .
4,992,042 2/1991 Kneupfer .
5,002,482 3/1991 Fairbanks et al. .
5,165,886 11/1992 Faigiere ..... 431/277 X
5,184,948 2/1993 Iwahori ..... 431/153
5,186,618 2/1993 Shike et al. ..... 431/276 X
5,205,727 4/1993 Iwahori ..... 431/153
5,213,493 5/1993 Iwahori ..... 431/153
5,215,458 6/1993 Cirami ..... 431/153 X
5,224,854 7/1993 Ansquer ..... 431/153
5,240,408 8/1993 Kenjiro et al. ..... 431/153
5,242,297 9/1993 Cirami ..... 431/153

CIGARETTE LIGHTER SAFETY WITH THUMB LOCKING MECHANISM

FIELD OF THE INVENTION

The present invention relates to a lighter having a safety device consisting of a locking mechanism for the thumb-piece of a cigarette lighter, the igniting of which either accidentally or by children is rendered virtually impossible.

BACKGROUND OF THE INVENTION

Cigarette lighters, particularly of the disposable type, are known which comprise, within a hollow body, a reservoir of combustible liquified gas, a pressure reducer mounted on an outlet of the reservoir and a burner with a valve on top of the pressure reducer, and means for igniting the gas escaping from the burner after the valve is opened. This igniting means most often consists of a wheel bearing against a flint, rotation of the wheel producing sparks which are projected over the burner.

Another solution which is becoming more widespread consists in substituting a piezo-electric igniter for the flint-wheel assembly. In both cases, the gas of the cigarette lighter is ignited by pressing on a thumb-piece which is either pivoted on the body of the cigarette lighter or which slides within the body. In addition to creating one or more sparks, the thumb-piece lifts the burner as it moves, which releases the gas which is to be ignited.

The thumb-piece is pressed by the user of the cigarette lighter. However, such depression may occur accidentally, for example in a pocket, or by an unauthorized "user" who might misuse the cigarette lighter.

In order to overcome this drawback, the provision of locking means for the thumb-piece has been proposed. When the thumb-piece is locked, the gas cannot escape from the reservoir and no spark can be generated. This is the safe position.

However, in order to use the cigarette lighter, the thumb-piece has to be unlocked without requiring any special skill. To this end, a "before igniting" position must exist in which the cigarette lighter is ready to operate simply by pressing on the thumb-piece as in the usual operation.

A cigarette lighter is described in FR-A2 633 702 which is provided with locking means in which there is a locked position of the thumb-piece and a stable unlocked position allowing conventional operation of the cigarette lighter. From the locked position, the safety mechanism is unlocked during a first time period. After this unlocking, the user can ignite the cigarette lighter at any time. Pressing on the thumb-piece automatically returns the locking mechanism to the locked position.

SUMMARY OF THE INVENTION

The present invention provides a lighter having a safety device for a cigarette lighter, of the type described above, which ensures safety of operation, particularly where children are concerned, but which is simpler in operation and of reduced cost.

The invention provides a locking mechanism for the thumb-piece of a cigarette lighter, the cigarette lighter comprising a body with a valve for releasing gas upon depression of the thumb-piece and a burner, i.e. an igniter. The thumb-piece, armed by a spring, is either pivoted or vertically movable, and means for blocking the movement of the thumb-piece, the locking mechanism being characterized in that a blot is mounted below said thumb-piece, in the body of the cigarette lighter, said bolt being constituted by a resilient part of closed outline including retractable stops for the thumb-piece, the skirt of the thumb-piece being split.

According to another feature of the invention, the blot includes a bearing part, the width of which is substantially equal to that of the split in the thumb-piece.

According to yet another feature of the invention, the bolt includes an arm perpendicular to the direction of movement of the thumb-piece, one end of the arm carrying the bearing part and the other end carrying a protruding portion intended to co-operate with a hook carried by the bolt.

DESCRIPTION OF THE DRAWINGS

Other features and advantages of the invention will be apparent from the following description of particular embodiments, given purely by way of non-limiting example, and with reference to the accompanying drawings.

DETAILED DESCRIPTION OF THE INVENTION

Figure 3:
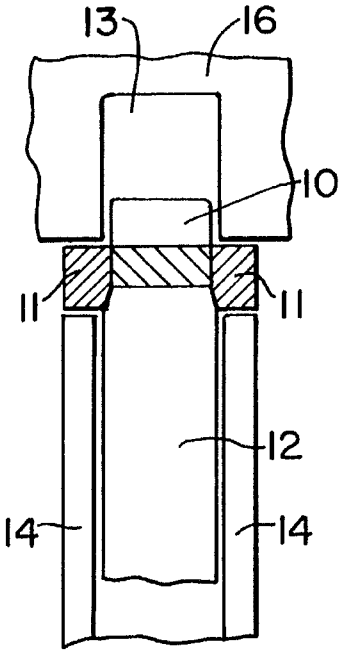
FIG. 3 is a side view along line III—III of FIG. 2.
Figure 1:
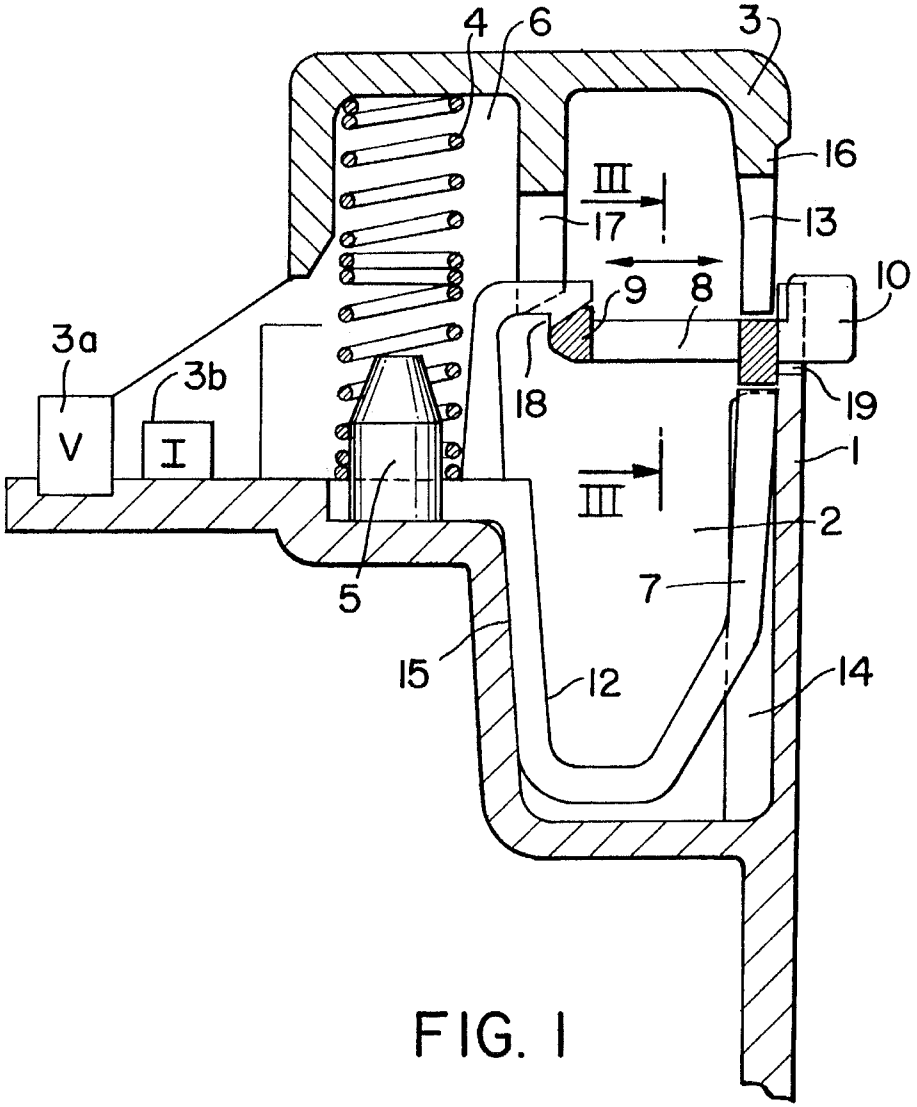
FIG. 1 shows a vertical section through the upper rear portion of a cigarette lighter provided with a locking mechanism of the invention, in the locked position and also showing in schematic the valve and burner, i.e. igniter.
Figure 2:
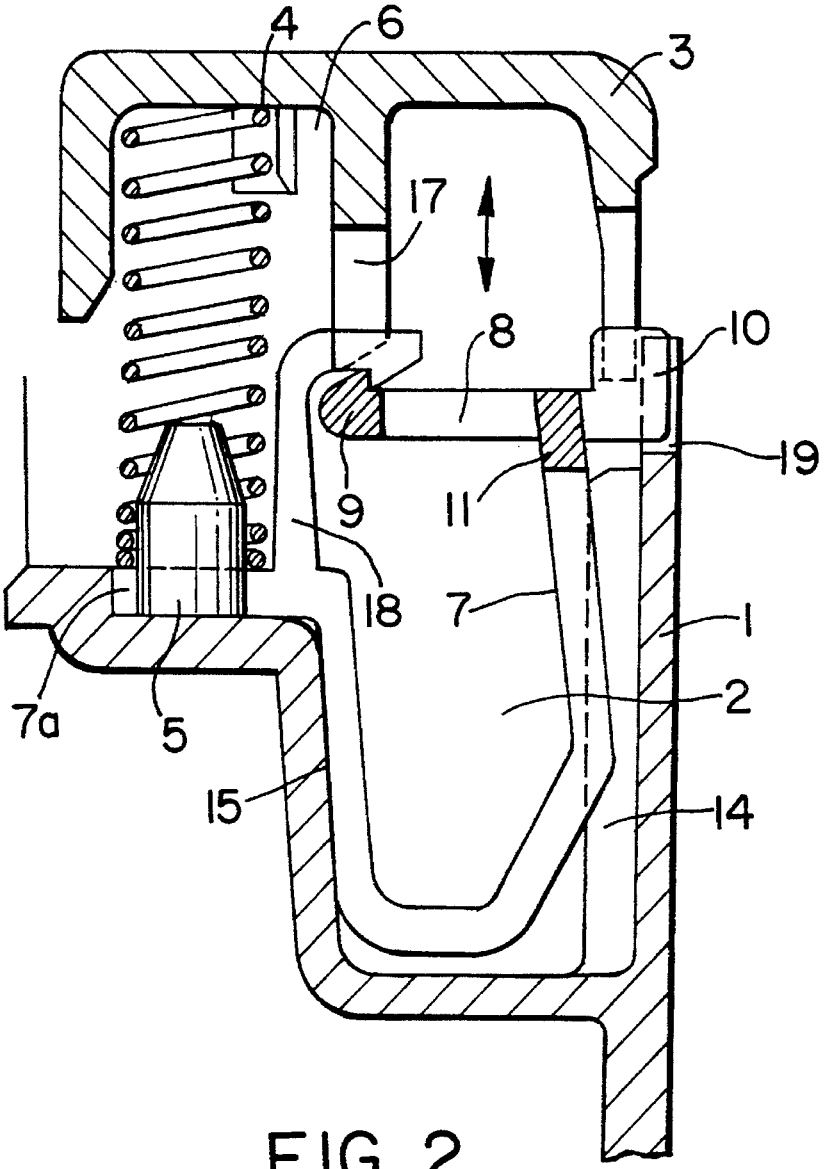
FIG. 2 shows in the same view, the unlocked or before-igniting position.

FIGS. 1 and 2 show the upper portion of the body of the cigarette lighter 1 which forms a cavity 2 inside which the thumb-piece 3 can move.

The lighter 1 includes a valve 3A associated with the lighter body and operatively connected to the thumb piece as it conventional. An igniter 3B, i.e. burner, is positioned on the lighter body. The valve discharges gas upon depression of the thumb piece. The gas is ignited by the burner 3B as is conventional.

The thumb-piece 3 is urged upwardly, in known fashion, by a return spring 4 held at its lower portion by a peg or boss 5, the upper surface of the return spring 4 bearing against the inside of a cavity 6 in the thumb-piece. A tongue 7A of the blot 7 is threaded around the boss 5 below the spring 4.

Figure 4:
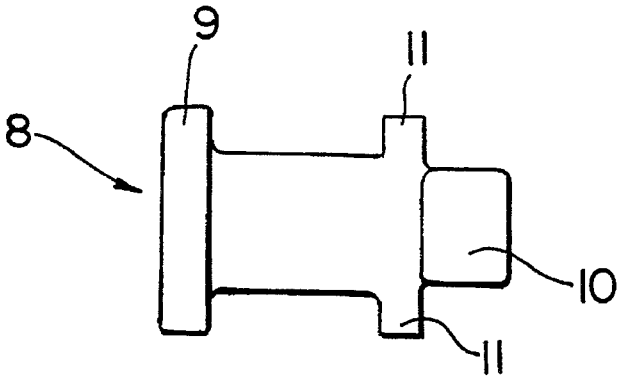
FIG. 4 is a view from above of the upper arm of the lock.

The bolt 7 is constituted by a resilient part, of plastics material for example, with a closed outline, the upper portion of which is constituted by an arm 8 having a forward portion 9 which protrudes and a rear portion 10 which is at the same height above the arm and which, in the locked position of the thumb-piece, protrudes radially outside the body of the cigarette lighter. The portion 10 constitutes a catch or bearing surface controlling the horizontal translational movement of the arm 8. The arm 8 also carries, on either side, two stops 11 for the thumb-piece, which are shown more clearly in FIG. 4.

The remainder of the bolt 7 is constituted by a portion 12 which is substantially U-shaped or hairpin-shaped. The portion 12 is held, on either side and at the outside of the cigarette lighter, by ribs 14 provided in the body 1. Inside the cigarette lighter, the portion 12 bears against a flat face 15, the safe and resilience of portion 12 causing it to be subjected to a light prestress when it is mounted in the body.

The skirt 16 of the thumb-piece 3, which constitutes the portion of the latter which enters the body when pressure is exerted, has a central split 13 the width of which is slightly greater than the width of the bearing surface 10. Moreover, the thumb-piece is provided with an unhooking fork in the shape of an inverted "U", which allows the portion 9 to be disengaged from the arm 8, out of the hook 18, when the thumb-piece is pressed down. The body 1 also has, at its upper exterior portion, a notch 19 in which the catch 10 can slide.

The locking device operates as follows. In the locked position shown in FIG. 1, the catch 10 is outside the body 1 of the cigarette lighter. The bevelled portion 9 of the arm 8 bears against the external portion of the hook 18.

Pushing on the catch 10 causes this catch to enter the notch 19 and the arm 8 to move horizontally (FIG. 2). This movement takes portion 9 into the hook 18 where it remains locked. Simultaneously, the thumb-piece stops 11 are moved forwardly to release a passage for the lower portion of the skirt 16. In this position, because of the split 13, the skirt 16 of the thumb-piece 3 can slide over the catch 10 which is in the cut-out 19. The cigarette lighter is then in the unlocked or "armed" position.

As in the case of a conventional cigarette lighter, ignition takes place by pressure of the user's thumb on the thumb-piece which causes:

1) descent of the latter inside the body of the cigarette lighter;
2) compression of the spring 4; and
3) unhooking of the arm 8 from the hook 18 due to the fork 17 bearing against the protruding portion 9.

During the descent of the thumb-piece, the arm 8 is still held in its forward position by the skirt 16, thereby conserving the elastic deformation of the part 12 of the bolt 7.

After ignition, the thumb-piece is released. The spring 4 returns it to the top of the cigarette lighter. The resilience of part 12 pushes the arm 8 back towards the outside.

The catch 10 then protrudes outside the body again, and the stops 11 again return underneath the skirt of the thumb-piece to block downward movement of the latter. This blocking prevents subsequent ignition as long as the catch 10 is not pushed towards the inside of the cigarette lighter again. The cigarette lighter may therefore be easily manipulated with just one hand in two stages which may be more or less close together. The blot 12 automatically returns the cigarette lighter to the locked position after ignition.

Clearly, numerous variations can be made, particularly by substituting equivalent technical means, without departing from the scope of the invention.

That which is claimed is:

1. A child resistant safety lighter comprising a lighter body having a lower reservoir section and an upper end forming a cavity, said upper end including valve means for discharging gas from said reservoir and an ignition means for igniting the discharged gas, a thumb-piece mounted at the upper end of the lighter body and vertically movable in the body cavity and operative with the reservoir valve means and burner upon depression of the thumb-piece for igniting the discharged gas, said thumb-piece having a split skirt forming a split opening, and a substantially U-shaped spring received within said cavity below said thumb-piece, said spring including an arm extending substantially transversely across the body cavity within the split opening, said arm being movable substantially perpendicular to the vertical movement of said thumb-piece and transverse to the lighter body and upper end from a first locked position where an end portion of the arm is extended out of the body to a second retracted, unlocked position where the end is positioned within the body, said spring including means for engaging said split skirt to prevent depression of said thumb-piece when said arm is in a locked position, said means for engaging being disengaged from said split skirt to allow depression of said thumb-piece when said arm is moved into an unlocked, retracted position and wherein said arm includes a hook, and said U-shaped spring includes means for receiving said hook for hooking same, and wherein said thumb-piece includes means for unhooking said hook upon depression of said thumb-piece.

2. A child resistant lighter according to claim 1 wherein said arm includes a forward portion which protrudes from the lighter body when the arm is in the first, locked position.

3. A child resistant lighter according to claim 1 wherein said means for engaging said split skirt comprises at least one stop member positioned on said arm.

4. A child resistant lighter according claim 1 wherein said lighter body includes ribs for holding the spring within the lighter body.

5. A safety lighter comprising a main body having a reservoir for holding a combustible fluid under pressure and an upper body portion, valve means mounted at the upper portion of said body and communicating with said reservoir for releasing fluid in a gaseous state, said valve means being normally closed, ignition means for igniting released fluid in a gaseous state, a valve actuator including a thumb-piece operatively engaged with said value means for releasing said gaseous fluid when said thumb-piece is depressed along a longitudinal axis of said body, said thumb-piece having a skirt and split opening forming a central slot, means positioned between said thumb-piece and said body for normally preventing said thumb-piece from being depressed along the longitudinal axis of said body thereby maintaining said thumb-piece in a locked position, spring means for applying an outward biasing force to said thumb-piece, wherein said locking mechanism comprises a rigid arm extending through said central slot and being movable in a direct perpendicular to said longitudinal axis of said body, said arm having a forward portion slidable from a position outside said body to a position within said body after said forward portion of said arm is depressed, at least one stop mounted on said arm adjacent said forward portion for engaging the skirt of said thumb-piece, said arm also including a rearward end opposite said forward end and including hook means for hooking and maintaining said arm in a depressed condition after said arm is depressed, allowing the skirt of the thumb-piece to slide within said body.

6. A lighter according to claim 5 wherein said spring means comprises a substantially U-shaped spring having two resilient legs extending in said longitudinal direction, said first leg being fixed inside said body, and said second leg being resiliently movable towards said first leg.

7. A lighter according to claim 6 including a tongue mounted within said body and engaging said first leg for fixing said leg within said body.

8. A lighter according to claim 5 wherein said first leg includes hooking means for hooking said arm.

9. A lighter according to claim 6 wherein said arm is integrally formed at the upper end of said second leg.

10. A lighter according to claim 5 wherein said thumb-piece includes an unlocking fork member configured as an inverted "U" for engaging said arm and disengaging said hook means when said thumb-piece is depressed.

* * * * *

UNITED STATES PATENT AND TRADEMARK OFFICE

CERTIFICATE OF CORRECTION

PATENT NO. : 5,472,338
DATED : December 5, 1995
INVENTOR(S) : Henri Ansquer

It is certified that error appears in the above-indentified patent and that said Letters Patent is hereby corrected as shown below:

Column 2, line 38, "it" should read --is--.

Column 4, line 16, "unhooking" should read --engaging--.

Column 4, line 38, "value" should read --valve--.

Column 4, line 52, "direct" should read --direction--.

In the Abstract, line 1, "value" should read --valve--.

Signed and Sealed this

Sixteenth Day of July, 1996

*Attest:*

*Attesting Officer*

Bruce Lehman

BRUCE LEHMAN

*Commissioner of Patents and Trademarks*